United States Patent [19]

Goldman

[11] Patent Number: 4,543,683

[45] Date of Patent: Oct. 1, 1985

[54] DEVICE FOR CLEANING STAYS

[76] Inventor: Scott M. Goldman, 14035 Tahiti Way, #232, Marina del Rey, Calif. 90272

[21] Appl. No.: 611,485

[22] Filed: May 17, 1984

[51] Int. Cl.[4] ..... B63B 59/00

[52] U.S. Cl. ..... 15/256.6; 15/104.04; 15/210 B

[58] Field of Search ..... 15/104.04, 256.6, 210 B; 114/221 R

[56] References Cited

U.S. PATENT DOCUMENTS

| | | | |
|---|---|---|---|
| 1,219,051 | 3/1917 | Tallaksen | 15/256.6 X |
| 1,407,674 | 2/1922 | Roepke | 15/160 |
| 1,748,900 | 2/1930 | Pilla | 15/256.6 |
| 2,285,742 | 6/1942 | Miller | 15/210 B |
| 2,821,730 | 2/1958 | Shellman | 15/256.6 X |
| 2,998,801 | 9/1961 | Edelberg | 15/104.04 X |
| 3,116,811 | 1/1964 | Stevenson | 184/17 |
| 3,791,330 | 2/1974 | Haddad | 114/221 |

*Primary Examiner*—Chris K. Moore

*Attorney, Agent, or Firm*—Paul R. Wylie

[57] ABSTRACT

A cleaning unit including a stay cleaning means such as a brush is mounted in the housing and is permitted to freely rotate around the axis of the stay. When the housing is moved up and down the length of the stay in a fixed angular position, the cleaning unit is free to rotate with the wind of the stay and thus the stay is cleaned.

10 Claims, 5 Drawing Figures

DEVICE FOR CLEANING STAYS

This invention relates generally to a device for cleaning stays of the type that are used on a sailboat for holding the mast in a fixed position.

BACKGROUND OF THE INVENTION

Stays that are commonly in the form of wound cables are used on sailboats for holding masts in fixed position. These stays, or guide wires as they are sometimes called, generally extend from the mast at various positions, most usually from an upper portion, to a point on the deck or hull of the boat. Commonly, these stays require frequent cleaning due to corrosion, rust and the collection of salt and dirt. This has been traditionally a manual operation requiring an individual to climb to the upper portions of the stays and hand clean them with handheld cleaning items such as cloths.

Several prior art patents have been directed to apparatus and devices for cleaning stays and these include U.S. Pat. Nos. 1,219,051; 1,407,674; 1,748,900; 3,116,811 and 3,791,330. These prior cleaning apparatus range from the simplistic device of the U.S. Pat. No. 3,791,330 patent to the rather complicated mechanism of U.S. Pat. No. 3,116,811. These prior art cleaning devices, however, have had problems either because the devices tend to wind the pulling cord or halyard around the stay, or the devices are mechanically complicated, unreliable and expensive to manufacture.

SUMMARY

According to this invention there is provided a stay cleaning device which comprises in combination a cleaning unit housing and a cleaning unit mounted therein.

The cleaning unit housing is adapted to be moved up and down along the length of the stay in fixed angular position. That is to say, the housing does not rotate around the axis of the stay. A cleaning unit including a stay cleaning means such as a brush is mounted in the housing and is permitted to freely rotate around the axis of the stay. When the housing is moved up and down the length of the stay in a fixed angular position, the cleaning unit is free to rotate with the wind of the stay and thus the stay is cleaned.

A halyard which is normally used on a sailboat for lifting the sails into position to catch the wind, can be used to tow the cleaning unit up and down along the length of the stay. In addition to the halyard, other lines that are normally used on a sailboat can be used for this towing purpose when connected to the cleaning unit.

It was an object of this invention to provide a stay cleaning device which would be reliable, and which would eliminate as many moving parts as possible.

Another object of this invention is a provision of a stay cleaning device that is relatively compact and could be operated with existing equipment on a sailboat.

A still further object of this invention was to provide a stay cleaning device which would not wind a halyard or line to which it was attached around the stay.

These and other objects of the invention were accomplished by the provision of a stay cleaning device wherein a simple housing can be moved up and down along the length of the stay in fixed angular position while a cleaning unit within the housing is free to rotate with the wind of the stay.

DESCRIPTION OF THE DRAWINGS

The invention will be more fully understood and described in connection with the drawings wherein.

DETAILED DESCRIPTION OF THE INVENTION

Figure 1:
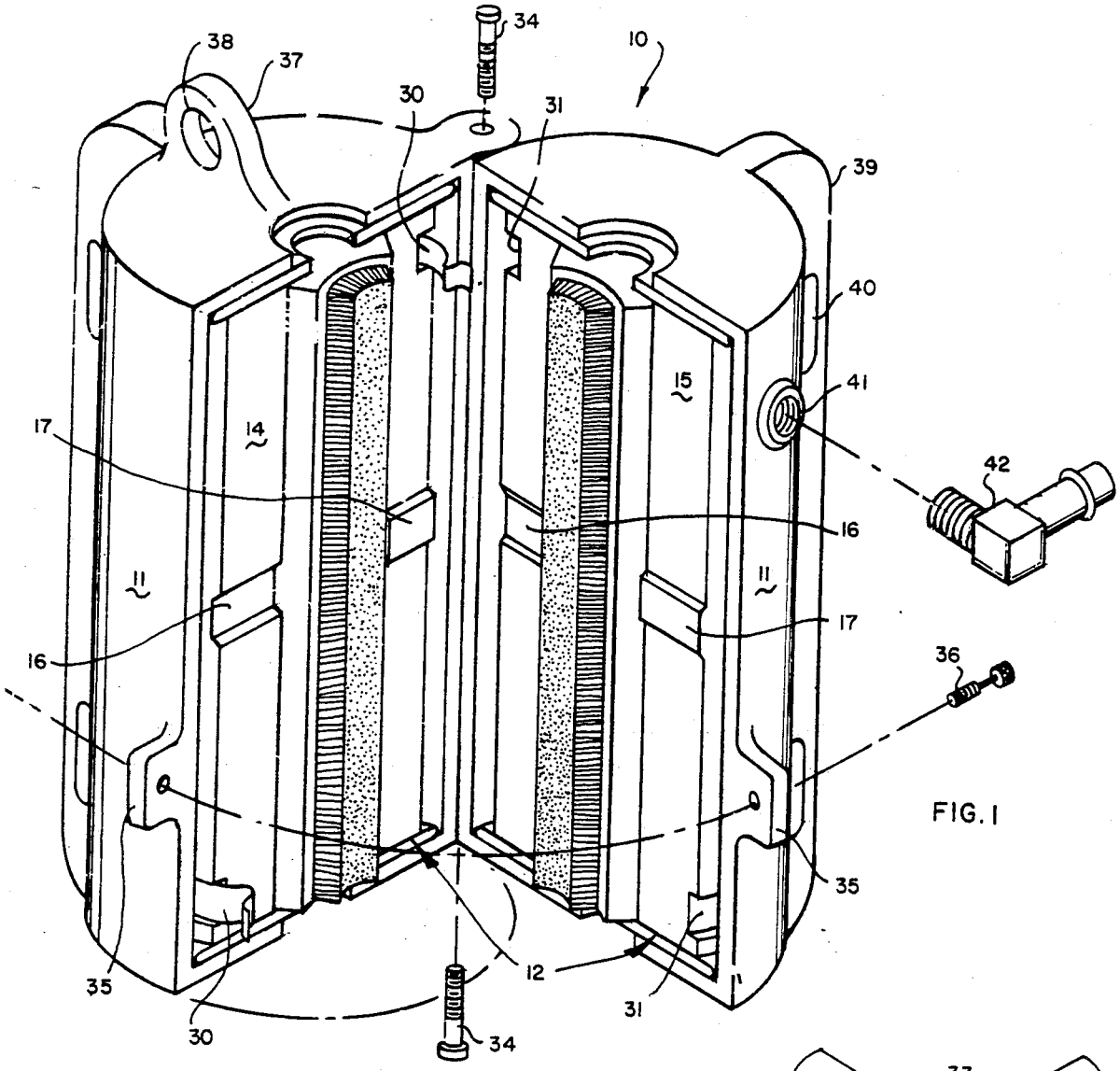
FIG. 1 is a view in perspective of the stay cleaning device according to this invention shown in an open position.
Figure 5:
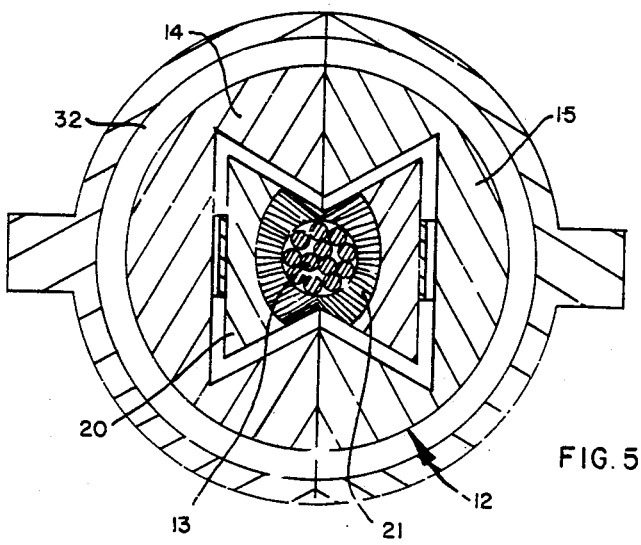
FIG. 5 is a view in cross-section taken on line 5—5 of FIG. 4.
Figure 2:
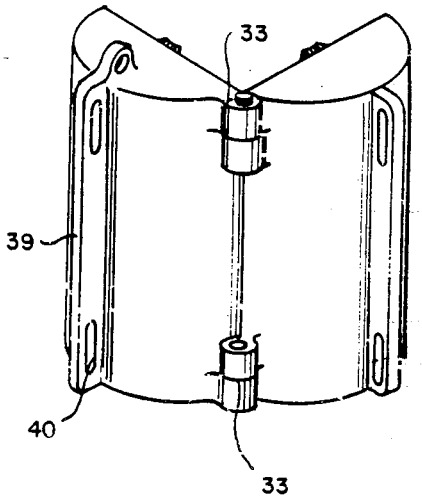
FIG. 2 is a rear view of the device shown in FIG. 1.
Figure 3:
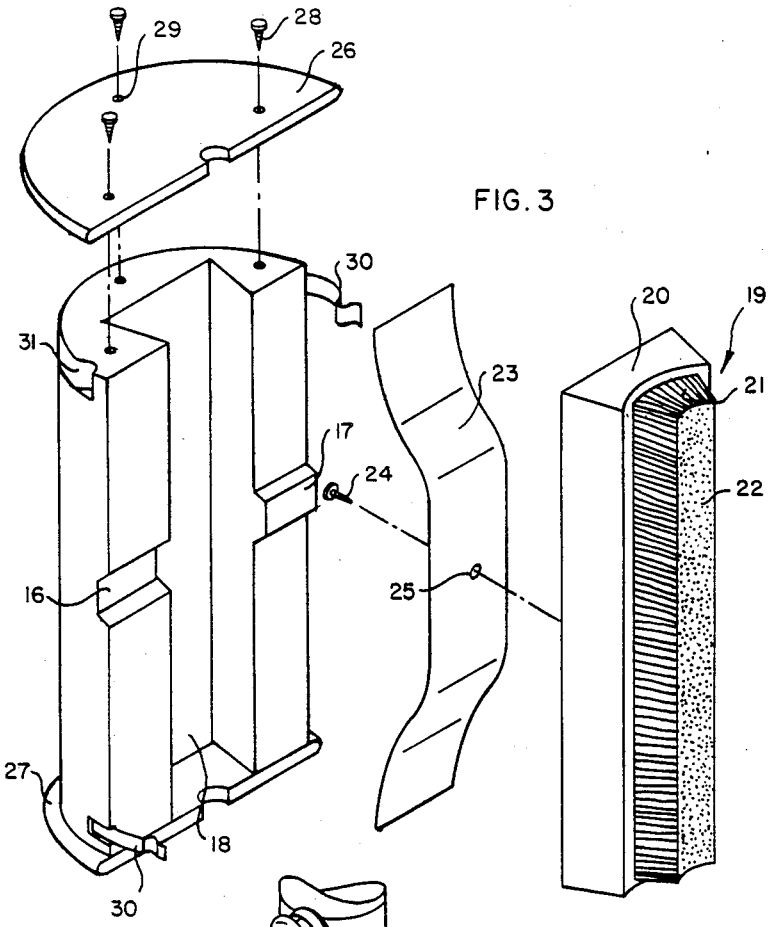
FIG. 3 is an exploded assembly view showing the cleaning unit of the stay cleaning device of this invention.
Figure 4:
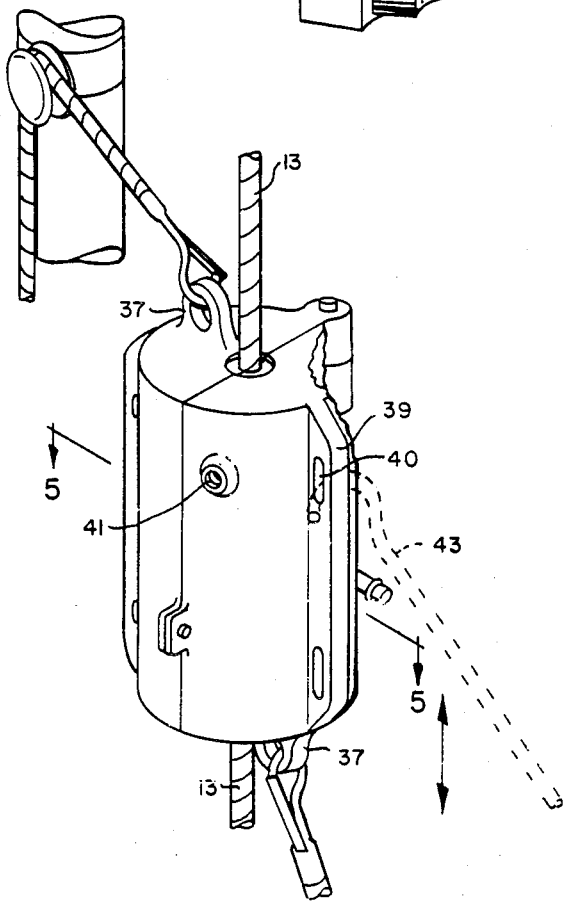
FIG. 4 is a perspective view showing the assembled cleaning unit in cleaning position on a stay.

Referring now to the drawings, there is shown a stay cleaning device 10 according to the invention. The stay cleaning device 10 includes a cleaning unit housing 11 and a cleaning unit 12 which is assembled of several different components. As shown in FIG. 4, cleaning unit housing 11 is adapted to be moved up and down the length of a stay 13 in a fixed angular position, that is to say it will not rotate with respect to the axis of the stay. Cleaning unit 12 on the other hand is mounted in housing 11 for free angular rotation around the axis of the stay so that it can follow the wind of the stay.

Cleaning unit 12 includes sector 14, and a like sector 15 which form halves of the cleaning unit. The sectors 14 and 15 include a slot 16 and a corresponding ridge 17 on the opposite side of the sector to provide alignment of the two sectors 14 and 15. In the middle of each sector 14 and 15 is a groove 18. Adapted to be placed in groove 18 is a brush assembly 19 which includes brush mounting base 20 and a brush 21 which has a concave surface 22.

Biasing spring 23 is provided to fit behind brush assembly 19 to force the brush assembly outwardly in the direction of the brush bristles 22. Biasing spring 23 can be fastened to brush base 20 by means of a fastener 24 which can be inserted through hole 25 in the biasing spring 23 and imbedded in brush base 20. Adapted to be positioned on the ends of sector 13 are bearing plates 26 and 27. These bearing plates in turn can be fixed by fasteners 28 which pass through holes 29 and are imbedded in the material of sectors 14 and 15. Fastened to sector 14 are spring clips 30 which are adapted to mate with spring clip retainer groove 31 in the mating sector 15.

housing 11 has a cylindrical interior section 32 into which cleaning unit 12 is inserted. Sectors 14 and 15 of cleaning unit 12 are assembled together by means of the spring clips 30 in sector 14 being snapped into spring clip retainer grooves 31 in sector 15. Similarly, ridges 17 fit into groove 16 on the opposite sector resulting in the formation of the fully assembled cleaning unit 12. The two halves of housing 11 are hinged together by hinges 33 fastened with hinge pins 34. The housing is locked together by locking flanges 35 which are locked by fastener 36.

At each end of housing 11 are pulling flanges 37 provided with holes 38. Housing 11 is further provided with side flanges 39 which in turn are provided with elongate holes 40.

Housing 11 is also provided with a threaded water inlet 41 to which a fitting 42 can be fixed.

In operation, after the two halves of cleaning unit 12 are placed over a stay 13 and the assembly closed and locked with spring clips 30 being engaged with retainer grooves 31, housing 11 is placed over cleaning unit 12 and closed and secured by fastener 36 through locking flanges 35. Brush 21 is forced by biasing spring 23 in contact with the wind of stay 13. Halyards or lines can be connected to flanges 37 whereby the cleaning device can be moved up and down along the length of the stay by pulling as shown in FIG. 4. Since the brush 21 is in contact with the wind of stay 13, the cleaning unit which is free to rotate within the interior cylindrical section 32 of housing 11 will rotate on bearing plates 26. Because the introduction of water to the interior housing 11 during the cleaning operation may be helpful to promote cleaning and remove debris that is brushed from the stay, such may be introduced during the cleaning operation through part 41 and fitting 42.

Housing 11 may also be positioned and moved up and down stay 13 by means of a boat hook 43 (as shown on dotted lines on FIG. 4) which can be inserted through elongate slots 40.

In accordance with an object of the invention, the parts of the cleaning device can be easily manufactured of desirable materials. Both the housing and the sectors of the cleaning unit can be made by means of injection molded plastics, composite materials such as filled plastics and/or metal or other materials with machining capabilities to create the structures described herein. The same is true of brush base 20. It is preferred to have bearing plates 26 manufactured of teflon materials because of their durability and lubricity.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A device for cleaning a stay or the like comprising in combination:

a. a cleaning unit housing adapted to be moved up and down along the length of said stay in substantially fixed angular position with respect to the axis thereof; and;

b. a cleaning unit including stay cleaning means adapted to clean said stay, said cleaning unit being mounted in said housing for free angular rotation around the axis of said stay, said cleaning unit comprising stay cleaning means adapted to contact the wind of said stay in cleaning relationship such that said cleaning unit is free to rotate around the axis of said stay when said cleaning unit housing is moved along the length thereof in said fixed angular position whereby said stay will be cleaned by said cleaning unit.

2. A stay cleaning device according to claim 1 further comprising means to move said cleaning unit housing along the length of a stay while maintaining said housing in fixed angular position with respect thereto.

3. A stay cleaning device according to claim 1 wherein said cleaning unit housing has a cylindrical interior portion and said cleaning unit is mounted for free rotation therein.

4. A stay cleaning device according to claim 3 wherein said cleaning unit is a cylindrical means and comprises at least two sectors adapted to be attached to each other to form said cylindrical means around said stay

5. A stay cleaning device according to claim 4 wherein said stay cleaning unit further comprises brush means capable of being fastened to said sectors.

6. A stay cleaning device according to claim 3 wherein said cleaning unit is provided with bearing means mounted for rotation within said cylindrical interior portion.

7. A stay cleaning device according to claim 1 wherein said stay cleaning means are brush(es) means adapted to contact said stay when said cleaning unit is in operable position on said stay.

8. A stay cleaning device according to claim 1 wherein said stay cleaning means have a concave surface.

9. A stay cleaning device according to claim 1 wherein said stay cleaning means are spring biased toward said stay.

10. A stay cleaning device according to claim 5 wherein said sectors are provided with grooves adapted to receive said brush means in locking relationship.

* * * * *